US010557480B1

(12) United States Patent
Gharakhanian et al.

(10) Patent No.: US 10,557,480 B1
(45) Date of Patent: Feb. 11, 2020

(54) PUMPING SYSTEMS AND METHODS

(71) Applicants: Razmik David Gharakhanian, Glendale, CA (US); Levik Kodaverdian, Glendale, CA (US); Mark S. Walker, Jr., Apple Valley, CA (US)

(72) Inventors: Razmik David Gharakhanian, Glendale, CA (US); Levik Kodaverdian, Glendale, CA (US); Mark S. Walker, Jr., Apple Valley, CA (US)

( * ) Notice: Subject to any disclaimer, the term of this patent is extended or adjusted under 35 U.S.C. 154(b) by 0 days.

(21) Appl. No.: 16/376,719

(22) Filed: Apr. 5, 2019

Related U.S. Application Data

(60) Provisional application No. 62/776,262, filed on Dec. 6, 2018.

(51) Int. Cl.

| | |
|---|---|
| ***F04F 1/02*** | (2006.01) |
| ***F04B 49/02*** | (2006.01) |
| ***F04B 23/04*** | (2006.01) |
| ***F04F 3/00*** | (2006.01) |

(Continued)

(52) U.S. Cl.
CPC ..... *F04F 1/02* (2013.01); *F04B 23/04* (2013.01); *F04B 49/02* (2013.01); *F04F 3/00* (2013.01); *F04B 15/02* (2013.01); *F04B 17/03* (2013.01)

(58) Field of Classification Search
CPC ..... F04B 49/02; F04B 15/02; F04B 23/04; F04B 17/00; F04B 9/12; F04B 9/1207; F04B 17/03; A47L 7/0038; F04F 1/02; F04F 3/00; F04F 5/48; F04F 5/52
See application file for complete search history.

(56) References Cited

U.S. PATENT DOCUMENTS 3,253,547 A * 5/1966 Weis ..... F04C 2/344 200/61.2
3,883,269 A * 5/1975 Wolff ..... B63B 27/24 417/122
4,179,768 A 12/1979 Sawyer
(Continued)

FOREIGN PATENT DOCUMENTS

EP 1920698 A1 5/2008
WO WO 95/18685 A1 7/1995

OTHER PUBLICATIONS

Matala Power-Cyclone Pond Vacuum with Dual Pump System by Matala product information, Accessed on Jan. 2, 2019.

*Primary Examiner* — Nathan C Zollinger
(74) *Attorney, Agent, or Firm* — Knobbe, Martens, Olson & Bear, LLP

(57) ABSTRACT

A pumping system includes a first chamber and a second chamber to receive filtered medium. The pumping system includes a first motor assembly and a second motor assembly operably coupled to the first chamber and the second chamber, respectively. The first motor assembly and the second motor assembly each includes a pair of vacuum motors arranged back-to-back so that one of the vacuum motors operates to generate a negative pressure force on the chamber and the other vacuum motor operates to generate a positive pressure force on the chamber. The first motor assembly and the second motor assembly work together to alternate between siphoning material having one or both a fluid and a solid into one of the chambers and ejecting siphoned debris from another chamber.

20 Claims, 9 Drawing Sheets

(51) Int. Cl.
*F04B 15/02* (2006.01)
*F04B 17/03* (2006.01)

(56) References Cited

U.S. PATENT DOCUMENTS

| | | | | |
|---|---|---|---|---|
| 4,841,595 | A | 6/1989 | Wiese | |
| 5,349,722 | A | 9/1994 | Chayer | |
| 5,525,042 | A * | 6/1996 | Batten | F04F 1/06 417/113 |
| 5,618,410 | A | 4/1997 | Wallace et al. | |
| 5,749,711 | A * | 5/1998 | Park | F04F 1/02 417/120 |
| 6,200,104 | B1 * | 3/2001 | Park | F04F 1/02 417/118 |
| 6,837,174 | B1 * | 1/2005 | Baurley | F04F 1/02 114/183 R |
| 7,942,649 | B2 * | 5/2011 | Lesther | F04C 11/001 417/248 |
| 8,146,201 | B2 | 4/2012 | Conrad | |
| 8,641,386 | B2 * | 2/2014 | Szuster | F04F 1/06 417/109 |
| 8,782,852 | B1 | 7/2014 | Henderson | |
| 9,765,769 | B2 * | 9/2017 | Cox | F04F 1/02 |
| 10,111,562 | B2 | 10/2018 | Fording et al. | |
| 2002/0152578 | A1 | 10/2002 | Lee | |
| 2017/0150646 | A1 * | 5/2017 | Verronen | F04D 13/06 |

* cited by examiner

PUMPING SYSTEMS AND METHODS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

This invention relates broadly to devices for siphoning material having one or both of fluid and solid (e.g., gases, rain water, mud, silt, waste, and the like) from one location and pumping the siphoned material to a remote location, and more particularly a pumping system that can be easily transported from one area to another area and provide continuous removal or transportation of fluid and/or solid between different locations (for example, removal of flood water from a flooded area).

Description of the Related Art

Homes and buildings can sustain water damage from a variety of sources, such as from flooding due to natural disasters (e.g., flooding due to heavy rain or due to storm surge from hurricanes), or due to other occurrences (e.g., water main breaks). Restoration of flooded homes often involves removing debris deposited over the flooring or carpeting in the home in order to then replace the flooring or carpeting. Such debris can be in the form of mud or silt, rocks, etc.

There are number of pumps designed to remove various types of material having one or both of fluid and solid (for example, floodwater and/or mud in a basement). Existing pumps utilize a mechanical valve that diverts the pressure between suction and purge. When mechanical valve malfunctions, the valve can no longer divert the pressure between suction (for siphoning liquid medium) and purge (for purging siphoned liquid medium), requiring maintenance of the pump and downtime in removing debris. Additionally, some existing pumps are submersible, which are difficult to access and repair when the pump malfunctions or needs repair while submerged. Another drawback of existing pumping systems is that the flow occurs through the pump, which can be damaged by siphoned material (e.g., silt, rocks, sticks), increasing their maintenance or downtime due to repairs.

SUMMARY OF THE INVENTION

In accordance with one aspect of the disclosure, a pumping system is provided that does not utilize mechanical valves for diverting pressure and that provides for continuous removal of debris.

In accordance with another aspect of the disclosure, a pumping system is provided that suctions the material having one or both of fluid and solid through the device in one location and expels the suctioned material to a second location without the suctioned material passing through the force actuation assembly that generates the negative pressure to suction the material into the device and the positive pressure to expel the suctioned material from the device.

In accordance with another aspect of the disclosure, a pumping system is provided that includes a force actuation assembly comprising a pair of vacuum motors coupled back to back (so that they apply a suction force in opposite directions) and in fluid communication with a chamber. The pair of vacuum motors are alternatively operated to apply a negative pressure force or a positive pressure force on the chamber to effect a filling or an emptying of the chamber without the use of a mechanical diversion valve to effect such suction or purging of the chamber.

In accordance with another aspect of the disclosure, a pumping system is provided that does not need to be submerged (e.g., in a flooded area) to operate.

In accordance with another aspect of the disclosure, a pumping system is provided that does not include the mechanical valve for diverting pressure and that uses motors that are not submerged under water. The pumping system can be easily transportable between different locations, to prevent water damage of the device, and to provide continuous removal of the debris.

In accordance with an aspect of the disclosure, a pumping system is disclosed. The pumping system can include an inlet conduit. The pumping system can also include an outlet conduit. The pumping system can also include a first chamber assembly that includes a first chamber. The first chamber can be in fluid communication with the inlet conduit and the outlet conduit. The pumping system can also include a first motor assembly in fluid communication with the first chamber assembly. The first motor assembly can include a first pair of vacuum motors coupled back-to-back so that a first vacuum motor of the first pair of vacuum motors operates as a vacuum to apply a negative pressure force to the first chamber, and so that a second vacuum motor of the first pair of vacuum motors operates as a blower to apply a positive pressure force to the first chamber. The pumping system can also include a controller configured to operate the first motor assembly to alternatively apply a negative pressure force on the first chamber to siphon material having one or both of fluid and solid through the inlet conduit and into the first chamber, and to apply a positive pressure force to the first chamber to purge the siphoned material from the first chamber without the first motor assembly coming into contact with the siphoned fluid and debris.

The pumping system can also include a second chamber assembly comprising a second chamber. The second chamber can be in fluid communication with the inlet conduit and the outlet conduit. The pumping system can also include a second motor assembly in fluid communication with the second chamber assembly. The second motor assembly can include a second pair of vacuum motors coupled back-to-back so that a first vacuum motor of the second pair of vacuum motors operates as a vacuum to apply a negative pressure force to the second chamber, and so that a second vacuum motor of the second pair of vacuum motors operates as a blower to apply a positive pressure force to the second chamber. The controller can be configured to operate the second motor assembly to alternatively apply a negative pressure force on the second chamber to siphon material having one or both of fluid and solid through the inlet conduit and into the second chamber, and to apply a positive pressure force to the second chamber to purge the siphoned material from the second chamber without the second motor assembly coming into contact with the siphoned fluid and debris.

The inlet conduit, the outlet conduit, the first chamber, and the first motor assembly can be in fluid communication via a conduit system. The first motor assembly can include a mounting plate to which the pair of vacuum motors are coupled. The controller can simultaneously and alternatingly operate the first motor assembly and the second motor assembly such that the first motor assembly generates negative pressure in the first chamber while the second motor assembly generates positive pressure in the second chamber, or the first motor assembly generates positive pressure in the first chamber while the second motor assembly generates negative pressure in the second chamber. The controller can simultaneously operate the first motor assembly and the second motor assembly such that the first motor assembly and the second motor assembly simultaneously generate negative pressure or positive pressure in the first chamber and the second chamber, respectively.

The pumping system can also include a pair of sensors on or in the first chamber at two locations of the first chamber. The pair of sensors can be configured to detect presence of material in the first chamber and to generate a signal corresponding to a chamber empty or a chamber full condition, and to send the signal to the controller. The controller can be configured to operate the first motor assembly to suction material having one or both of fluid and solid into the first chamber upon receipt of said chamber empty signal and configured to operate the first motor assembly to purge the material from the first chamber upon receipt of said chamber full signal. The pair of sensors can be capacitance sensors.

The pumping system can receive a continuous intake of siphoned material having one or both of fluid and solid via the inlet conduit. The first chamber assembly and the second chamber assembly can be fluidly isolated such that the siphoned material cannot flow from the first chamber to the second chamber or from the second chamber to the first chamber.

The pumping system can also include a filter system in fluid communication with the inlet conduit and comprising one or more filters. The first motor assembly may not include a mechanical diverting valve to effect suction into and purge out of the first chamber.

According to another aspect of the disclosure, a pumping system for removing fluid and debris from flooded areas is disclosed. The pumping system can include an inlet conduit. The pumping system can also include an outlet conduit. The pumping system can also include a first chamber assembly including a first chamber. The first chamber assembly can be in fluid communication with the inlet conduit and the outlet conduit. The pumping system can also include a first motor assembly in fluid communication with the first chamber. The first motor assembly can include a first pair of vacuum motors coupled back-to-back so that a first vacuum motor of the first pair of vacuum motors operates as a vacuum to apply a negative pressure force to the first chamber, and so that a second vacuum motor of the first pair of vacuum motors operates as a blower to apply a positive pressure force to the first chamber. The pumping system can also include a second chamber assembly including a second chamber. The second chamber assembly can be in fluid communication with the inlet conduit and the outlet conduit. The pumping system can also include a second motor assembly in fluid communication with the second chamber assembly. The second motor assembly can include a second pair of vacuum motors coupled back-to-back so that a first vacuum motor of the second pair of vacuum motors operates as a vacuum to apply a negative pressure force to the second chamber, and so that a second vacuum motor of the second pair of vacuum motors operates as a blower to apply a positive pressure force to the second chamber. The pumping system can also include a controller configured to operate the first motor assembly to alternatively apply a negative pressure force on the first chamber to siphon material having one or both of fluid and solid through the inlet conduit and into the first chamber, and apply a positive pressure force to the first chamber to purge the siphoned material from the first chamber without the first motor assembly coming into contact with the siphoned material. The controller can also be configured to operate the second motor assembly to alternatively apply a negative pressure force on the second chamber to siphon material having one or both of fluid and solid through the inlet conduit and into the second chamber, and apply a positive pressure force to the second chamber to purge the siphoned material from the second chamber without the second motor assembly coming into contact with the siphoned fluid and debris.

The controller can simultaneously operate the first motor assembly and the second motor assembly such that the first motor assembly and the second motor assembly simultaneously generate negative pressure or positive pressure in the first chamber and the second chamber, respectively. The first motor assembly and the second motor assembly can simultaneously and alternatingly operate such that the first motor assembly generates negative pressure in the first chamber while the second motor assembly generates positive pressure in the second chamber, or the first motor assembly generates positive pressure in the first chamber while the second motor assembly generates negative pressure in the second chamber.

The pumping system can also include a first pair of sensors on or in the first chamber at two locations of the first chamber. The first pair of sensors can be configured to detect presence of material in the first chamber and to generate a signal corresponding to a chamber empty or a chamber full condition, and to send the signal to the controller. The controller can be configured to operate the first motor assembly to suction material having one or both of fluid and solid into the first chamber upon receipt of said chamber empty signal and configured to operate the first motor assembly to purge the material from the first chamber upon receipt of said chamber full signal. The pumping system can also include a second pair of sensors on or in the second chamber at two locations of the second chamber. The second pair of sensors configured to detect presence of material in the second chamber and to generate a signal corresponding to a chamber empty or a chamber full condition, and to send the signal to the controller. The controller can be configured to operate the second motor assembly to suction material having one or both of fluid and solid into the second chamber upon receipt of said chamber empty signal and configured to operate the second motor assembly to purge the material from the second chamber upon receipt of said chamber full signal.

The inlet conduit, the first chamber assembly, the second chamber assembly, the first motor assembly, and the second motor assembly can be in fluid communication via a conduit system.

According to another aspect of the disclosure, a method of pumping material having one or both of fluid and solid using a pumping system is disclosed. The method can include the step of generating negative pressure in a first chamber using a first vacuum motor of a first motor assembly, the negative pressure in the first chamber siphoning material having one or both of fluid and solid into the first chamber from an inlet conduit via a first fluid path. The method can also include the step of determining whether the first chamber is ready to be emptied. The method can also include the step of, upon determining that the first chamber is ready to be emptied, generating positive pressure in the first chamber with a second vacuum motor of the first motor assembly, the positive pressure in the first chamber ejecting the siphoned material from the first chamber and through the outlet conduit. The method can also include the step of, simultaneously with generating the positive pressure in the first chamber, generating negative pressure in a second chamber with a first vacuum motor of the second motor assembly, the negative pressure in the second chamber siphoning material having one or both of fluid and solid into the second chamber from the inlet conduit via a second fluid path, the second fluid path different from the first fluid path. The method can also include the step of determining whether the second chamber is ready to be emptied. The method can also include the step of, upon determining that the second chamber is ready to be emptied, generating positive pressure in the second chamber with a second vacuum motor of the second motor assembly, the positive pressure in the second chamber ejecting the siphoned material from the second chamber and through the outlet conduit. The method can also include the step of, simultaneously with generating positive pressure in the second chamber, generating negative pressure in the first chamber using the first vacuum motor of the first motor assembly.

The step of determining whether the first chamber is ready to be emptied can include detecting presence of the siphoned material using a sensor coupled to or proximate a top portion of the first chamber. The sensor can be configured to generate an electronic signal indicative of presence or absence of the siphoned material. The step of determining whether the first chamber is ready to be emptied can also include receiving, from the sensor, an electronic signal indicative of presence of the siphoned material proximate to the top portion of the first chamber.

The step of determining whether the second chamber is ready to be emptied can include detecting presence of the siphoned material using a sensor coupled to or proximate a top portion of the second chamber. The sensor can be configured to generate an electronic signal indicative of presence or absence of the siphoned material. The step of determining whether the second chamber is ready to be emptied can also include receiving, from the sensor, an electronic signal indicative of presence of the siphoned material proximate to the top portion of the second chamber.

DETAILED DESCRIPTION

Overview

Figure 1A:
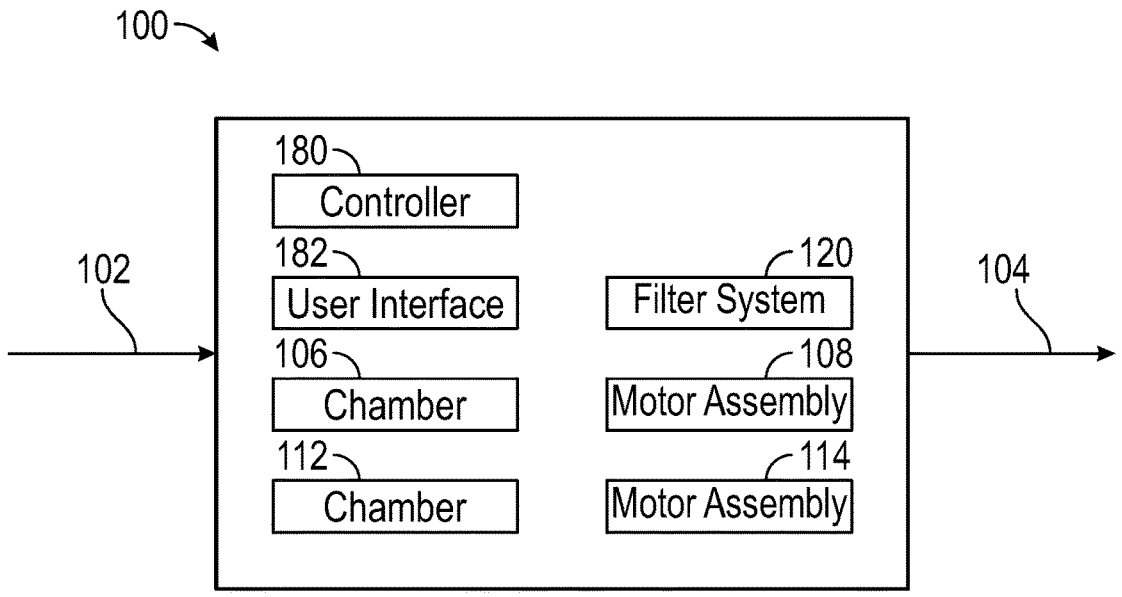
FIG. 1A is a block diagram of an example pumping system.

Referring to FIG. 1A, an example pumping system 100 is disclosed. The pumping system 100 can include an inlet conduit 102 and an outlet conduit 104. The inlet conduit 102 can allow materials having one or both liquid or solid to be siphoned into the pumping system 100 while the outlet conduit 104 can allow siphoned material to be removed from the pumping system 100. Optionally, the inlet conduit 102 and the outlet conduit 104 can be a flexible hose with an opening to allow materials to enter and/or exit. Optionally, the inlet conduit 102 can have an end attachment (e.g., wand) to facilitate siphoning different types of materials. The pumping system 100 can siphon various types of materials including organic wastes, inorganic wastes, gaseous or liquid substances including chemicals, floodwater, mud, silt, various types of gases, food products, and the like. In some implementations, the pumping system 100 can be used to remove debris from flooded areas.

The pumping system 100 can include a first chamber 106, a first motor assembly 108, a second chamber 112, a second motor assembly 112, a filter system 120, a controller 180, and a user interface 182. Though FIG. 1A shows two chambers 106, 112 and two motor assemblies 108, 114, the pumping system 100 can have fewer (e.g. one) or more (e.g., three, four, etc.) of these components. In another implementation, the filter system 120 can be excluded.

A proximal (e.g., upstream) end of the filter system 120 can be in fluid communication with the inlet conduit 102 to receive debris entering the pumping system 100. A distal (e.g., downstream) end of the filter system 120 can be in fluid communication with a piping system, the first chamber 106, the second chamber 112, and the outlet conduit 104 of the pumping system 100. Additional details of the filter system 120 will be provided below.

Optionally, the filter system 120 can include a filter (e.g., basket) with openings sized to allow fluid and/or smaller sized debris objects (e.g., water, mud, silt, pebbles, etc.) to pass therethrough but capture larger solid debris objects (e.g., rocks, sticks). In some implementations, the filter system 120 can include a filter that can filter certain types of gas and/or gas molecules. In other implementations, the filter system 120 can include a filter that can filter certain types of liquids. For example, the filter system 120 may be able to filter oil from water.

The first chamber 106 and the second chamber 112 can be located downstream of and in fluid communication with the filter system 120. The first chamber 106 and the second chamber 112 can receive the fluid and/or smaller sized debris objects separated by the filter system 120. The first chamber 106 and the second chamber 112 can fill with the fluid and/or smaller sized debris separated by the filter system 120. In some examples, both the first chamber 106 and the second chamber 112 can simultaneously receive the fluid and/or smaller sized debris objects from the filter system 120. Alternatively, the first chamber 106 and the second chamber 112 do not simultaneously receive the fluid and/or smaller sized debris objects from the filter system 120. For example, the first chamber 106 can receive the fluid and/or smaller sized debris objects from the filter system 120 while the second chamber 112 may not receive the fluid and/or smaller sized debris objects from the filter system 120. Similarly, the second chamber may 110 receive the fluid and/or smaller sized debris objects from the filter system 120 while the first chamber 106 may not receive the fluid and/or smaller sized debris objects from the filter system 120. The first chamber 106 and second chamber 112 can alternatingly receive and/or fill with the fluid and/or smaller sized debris objects.

The first motor assembly 108 and the second motor assembly 112 can be in fluid communication with the first chamber 106 and the second chamber 112, respectively. The first motor assembly 108 can be operated to remove air from (e.g., apply a suction or negative pressure force on) or blow air into (e.g., apply a positive pressure force on) the first chamber 106. Similarly, the second motor assembly 108 can be operated to remove air from (e.g., apply a suction or negative pressure force on) or blow air into (e.g., apply a positive pressure force on) the first chamber 106. Further discussion of the operation of the motor assemblies 108, 112 with respect to the chambers 106, 112 will be provided further below.

The pumping system 100 can include a controller 180. The controller 180 can receive and/or send signals to different electrical components and/or parts of the pumping system 100. The controller 180 can generate electronic signals to control operation of the first motor assembly 108 and the second motor assembly 114. Optionally, the controller 180 can receive electronic signals from the chambers (for example, from sensors in or on the first chamber 106 and the second chamber 112) and can optionally control operation of the first motor assembly 108 and the second motor assembly 114 based at least in part on the received electronic signals from the chambers 106, 112, as further described below.

The pumping system 100 can include a user interface 182. The user interface 182 can optionally be attached to a frame or housing H of the pumping system 100. In another implementation, user interface 182 can be located remotely from the frame or housing H of the pumping system 100 and can communicate with the electronics (e.g., motor assemblies 108, 114, sensors, etc. in a wired or wireless manner. The user interface 182 can electrically communicate with the controller 180 (e.g., via a wired or wireless connection) such that the user interface 182 can send to and/or receive electronic signals from the controller 180. The user interface 182 can allow a user to control the operation of the pumping system 100 by communicating with the controller 180. In some implementations, the user interface 182 can be integrated to an application run on mobile devices such as a mobile phone, a tablet, a laptop, and the like.

For example, users can interact with the user interface 182 to control operation of the motor assemblies (for example, the first motor assembly 108 and the second motor assembly 114) to generate negative and/or positive pressures in the chambers (for example, the first chamber 106 and the second chamber 112). As discussed above, generating negative and positive pressures in the chambers can control flow of liquid through the pumping system 100. In this regard, by controlling operation of the motor assemblies via the user interface 182, users can control operation of the pumping system 100. Further discussion of the method of operation of the motor assemblies 108, 114 and the pumping system 100 is provided below.

Piping System

Figure 1B:
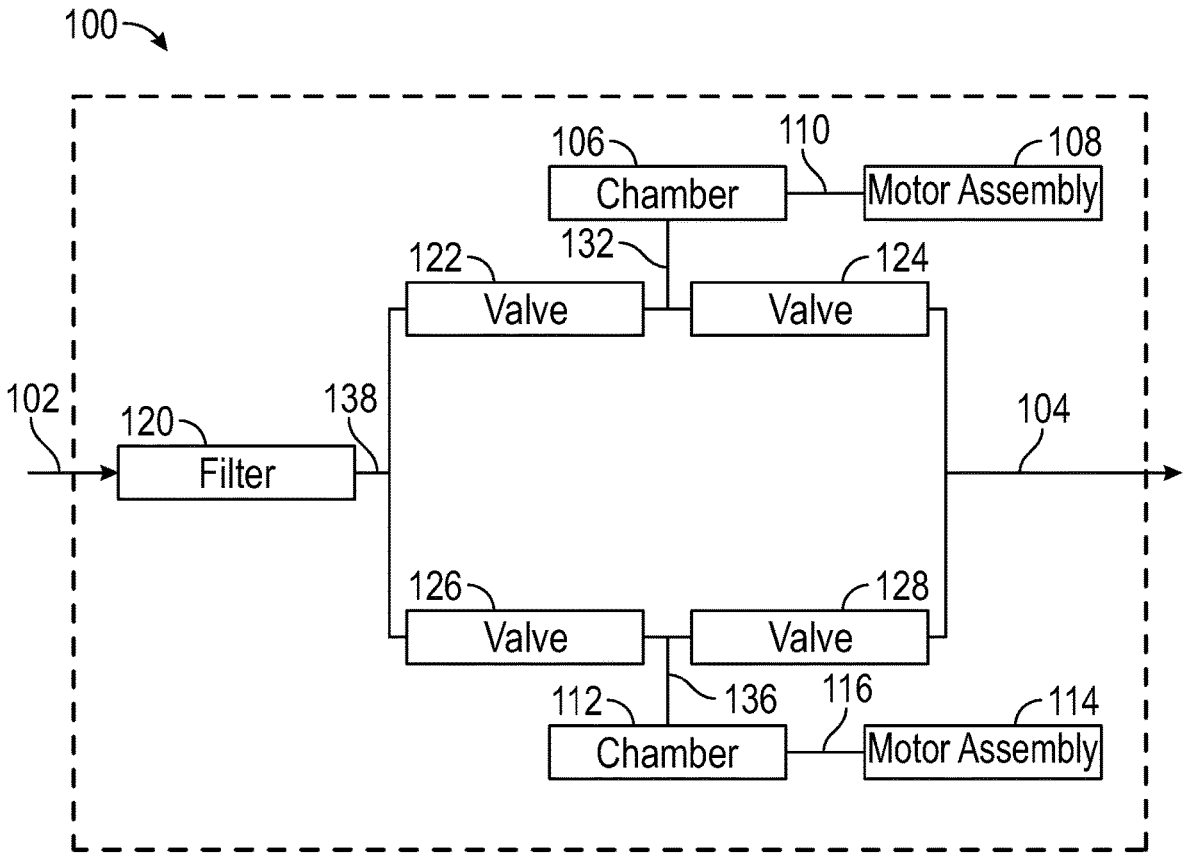
FIG. 1B is a block diagram showing additional details of the example pumping system of FIG. 1A.

FIG. 1B illustrates additional details of the pumping system 100. The pumping system 100 can include a conduit system that interconnects different components of the pumping system 100. As discussed above, the filter system 120 can be in fluid communication with the first chamber 106 and the second chamber 112. Additionally, the first chamber 106 and the second chamber 112 can be in fluid communication with the outlet conduit 104 and the first motor assembly 108 and the second motor assembly 114, respectively.

The filter system 120 can be in fluid communication with a conduit 138 to receive fluid and/or small sized debris objects exiting from the filter system 120. In the example pumping system 100 illustrated in FIGS. 1B and 1C, the conduit 138 is in fluid communication with a valve 122 and a valve 126. The valve 122 can allow the fluid and/or smaller sized debris objects exiting the filter system 120 to flow towards the first chamber 106 via the conduit 138, the valve 122, and a conduit 132. In some implementations, the valve 122 can be a check valve that only allows unidirectional flow. In this regard, the fluid and/or smaller objects exiting the filter system 120 can flow through the valve 122 and into the first chamber 106 but not the other way. Accordingly, the fluid and/or smaller sized debris objects cannot flow from the first chamber 106 to the filter system 120 via the valve 122.

The valve 126 can allow the fluid and/or smaller sized debris objects exiting the filter system 120 to flow to the second chamber 112 via the conduit 138, the valve 126, and a conduit 136. In some examples, the valve 126 can be a check valve that only allows unidirectional flow. In this regard, the fluid and/or smaller sized debris objects exiting the filter system 120 can flow through the valve 126 and into the second chamber 112 but not the other way. Accordingly, the fluid and/or smaller sized debris objects cannot flow from the second chamber 112 to the filter system 120 via the valve 126.

The conduit system of the pumping system 100 can include a valve 124 and a valve 128. The valve 124 can allow the fluid and/or smaller sized debris objects exiting the first chamber 106 via the conduit 132 to flow through the valve 124 and exit the pumping system 100 via the outlet conduit 104. In some examples, the valve 124 is a check valve that only allows unidirectional flow. The valve 124 can prevent debris and/or fluid flowing into the pumping system 100 via the outlet conduit 104 and through the valve 124 but not the other way. Likewise, the valve 128 can allow the fluid and/or smaller sized debris objects to exit the second chamber 112 via the conduit 136 and the valve 128 and exit the pumping system 100 via the outlet conduit 104. In some examples, the valve 128 is a check valve that only allows unidirectional flow. In this regard, the valve 128 can prevent fluid and/or smaller sized debris objects from flowing from the outlet conduit 104 to the second chamber 112 via the valve 128 but not the other way.

The valve 122 and the valve 124 can be in fluid communication with the conduit 132 and the first chamber 106. The valve 124 can be in fluid communication with the outlet conduit 104. The valve 126 and the valve 128 can be in fluid communication with the conduit 136 the second chamber 112. The 128 can be in fluid communication with the outlet conduit 104.

Example Pumping system

Figure 1C:
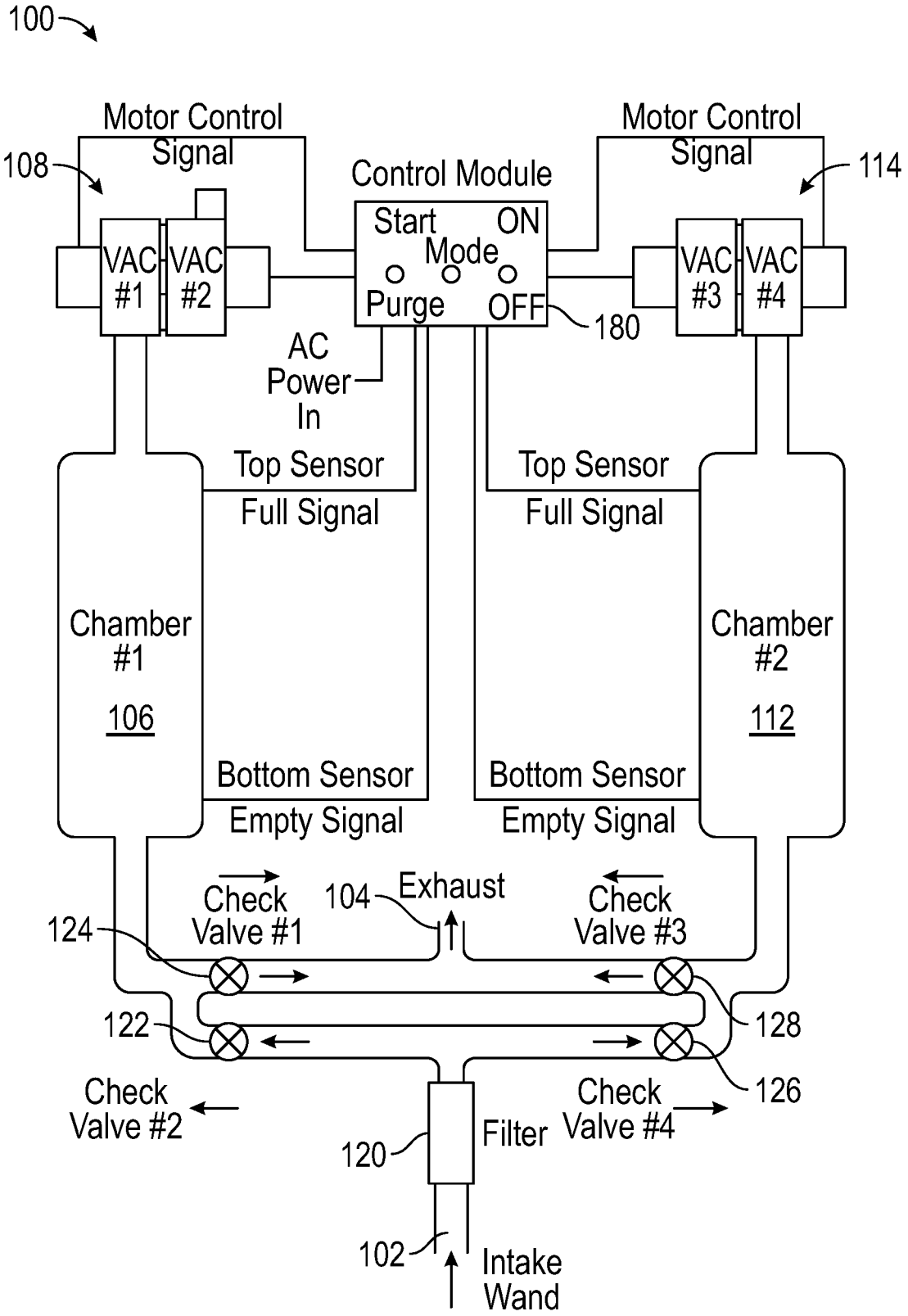
FIG. 1C is another block diagram showing additional details of the example pumping system of FIG. 1A.

An example of the pumping system 100 is illustrated in FIG. 1C. The inlet conduit 102 (or inlet wand) can allow material having one or more of fluid and solid to enter into the pumping system 100. As noted above, the material may be debris from flooded area. The filter system 120 can filter fluid and/or smaller sized debris objects from larger solid debris objects (e.g., rocks, sticks) and allow the fluid and/or smaller sized debris objects to flow into the first chamber 106 and/or the second chamber 112 via the valve 112 and valve 126, respectively, to fill the first chamber 106 and/or the second chamber 112. The fluid and/or smaller sized debris objects in the first chamber 106 and/or the second chamber 112 can then be emptied via the valve 124 and the valve 128, respectively. The fluid and/or smaller sized debris objects can be ejected from the pumping system 100 via the outlet conduit 104 (or exhaust).

The first chamber 106 and the second chamber 112 can be coupled to the first motor assembly 108 and the second motor assembly 114, respectively, via one or more conduits as previously described. Advantageously, the first and second chambers 106, 112 fill and empty without the motor assemblies 108, 114 coming in contact with the fluid and/or smaller sized debris objects that flow through the pumping system 100, thereby advantageously inhibiting (e.g., preventing) damage of the motor assemblies 108, 114.

The chambers 106, 112 can include one or more sensors 420, 422, 424, 426 (see FIGS. 4B-4C) that can detect presence and/or absence of liquid in the chambers 106, 112 and communicate such signals to the controller 180. The sensors 420, 422, 424, 426 may be capacitance sensors. However, the sensors 420, 422, 424, 426 can be other suitable type of sensors (e.g., optical sensors, ultrasonic sensors, etc.). The sensors 420, 422, 424, 426 can generate electronic signals and transmit them to the controller 180 as shown in FIG. 1C. The controller 180 can use the electronic signals from the sensors 420, 422, 424, 426 to generate and transmit electronic signals for controlling operation of the motor assemblies 108, 114. The electronic signals from the controller 180 can cause the motor assemblies to blow air into (e.g., apply a positive pressure force on) or remove air from (e.g., apply a negative pressure force on) the chambers 106, 112. Additional details regarding the sensors 420, 422, 424, 426 and operation of the motor assemblies 108, 114 will be described further below.

The first chamber 106 and the second chamber 112 can optionally be transparent. This can be advantageous by allowing users to visually confirm operation of the pumping system 100. Additionally, transparent chambers can allow users to better troubleshoot operation of the pumping system 100 by visually monitoring suction/purge of filtered water in the chambers 106, 112.

The pumping system 100 and its various components (for example, the first motor assembly 108, the second motor assembly 114, the controller 180, and the user interface 182) can optionally receive power from an external power source (e.g., wall outlet, generator). Alternatively, the power source can be one or more batteries mounted on the frame or housing H of the pumping system 100. The controller 180 may receive power from the external power source and supply power to other components of the pumping system 100. Additionally and/or optionally, the controller 180 can transmit power to the motor assemblies.

Optionally, the controller 180 can have a wired and/or wireless communication capability (e.g., via radio frequency (RF) communication, Wi-Fi, BLUETOOTH®, etc.). In this regard, the controller 180 can communicate with other controllers 180 of other pumping systems 100.

Figure 1D:
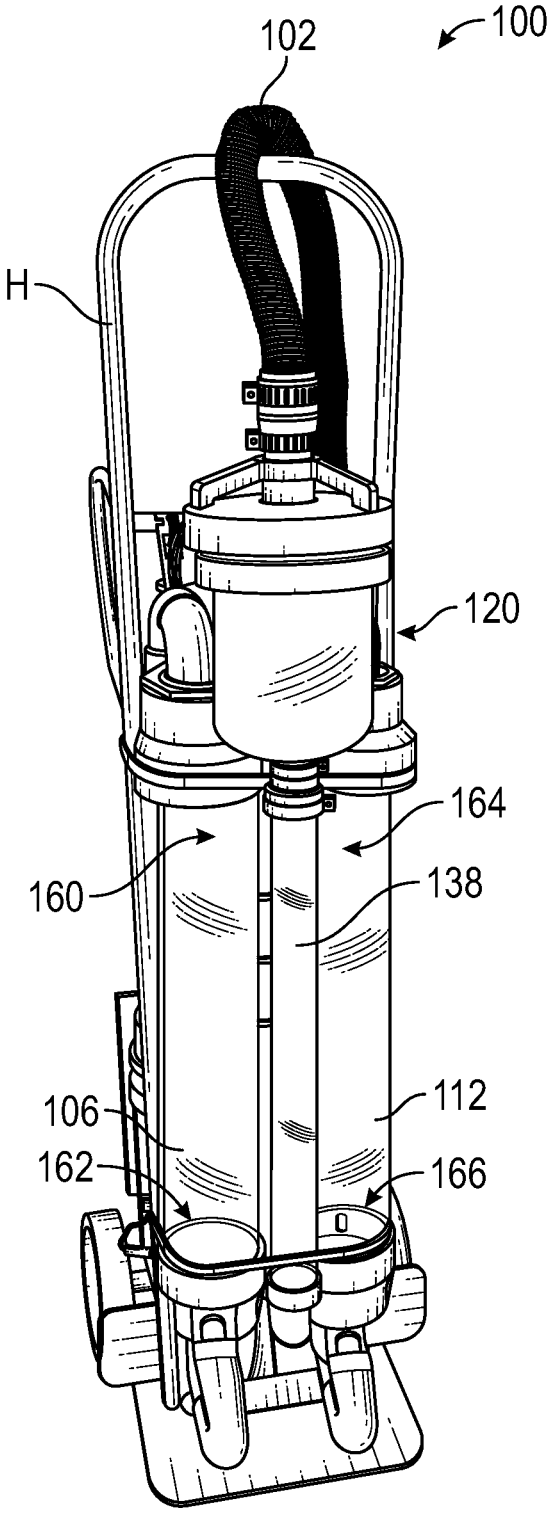
FIG. 1D is a perspective front view of the example pumping system of FIGS. 1A-1C.

FIG. 1D illustrates a front perspective view of an example pumping system 100. In this example, the inlet conduit 102 is in fluid communication with a top portion of the filter system 120. The conduit 138 can be in fluid communication with a bottom portion of the filter system 120. This configuration can advantageously allow the filter system 120 to utilize the gravitational force to filter fluid and/or smaller sized debris objects from the debris siphoned into the pumping system 100. Additionally and/or alternatively, this configuration can aid in inhibiting (e.g., preventing) the filtered liquid from exiting from the pumping system 100 via the filter system 120. The example pumping system 100 can include the first chamber 106 and the second chamber 112. However, as discussed previously, in another implementation, the system 100 can have fewer (e.g., one) or more (e.g., three, four, etc.) chambers and associated motor assemblies.

Motor Assembly

Referring to FIGS. 2A-2E, an example motor assembly of the pumping system 100 is described. As illustrated in FIGS. 1B and 1C, the pumping system 100 can include the first motor assembly 108 in fluid communication with the first chamber 106 and the second motor assembly 114 in fluid communication with the second chamber 112. The motor assemblies advantageously do not include a mechanical valve (e.g., between the motor assemblies 108, 114 and the chambers 106, 112) to divert between negative pressure (for example, to suction debris into the chambers 106, 112) and positive pressure (for example, to purge debris from the chambers 106, 112).

Figure 2A:
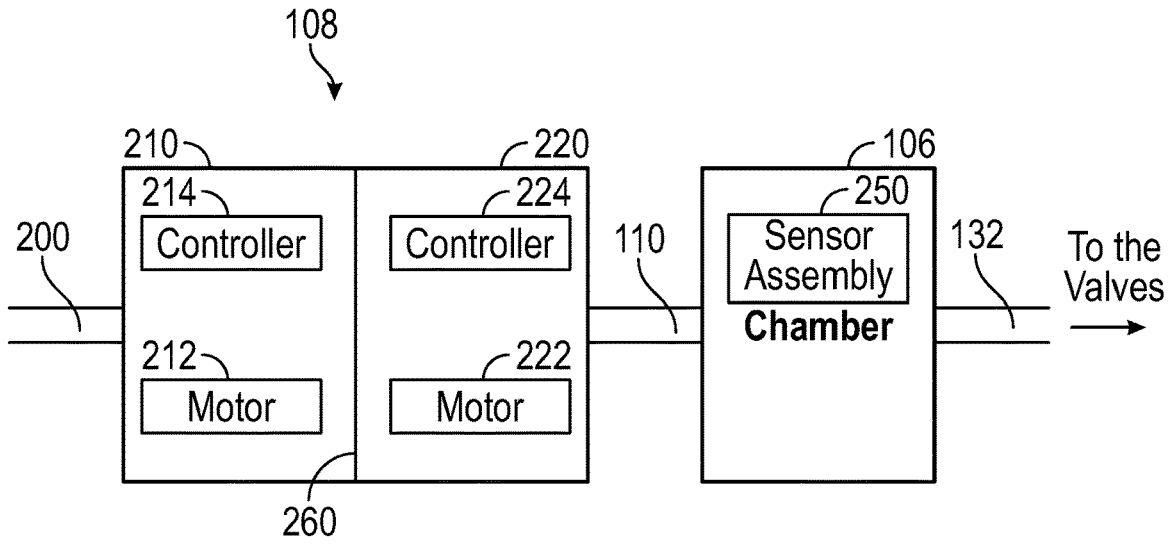
FIG. 2A is a block diagram of an example motor assembly.

FIG. 2A illustrates additional details of the first chamber 106 and the first motor assembly 108. The first chamber 106 and the first motor assembly 108 can be in fluid communication via a conduit 110. The conduit 110 can be attached to the top portion 160 of the first chamber 106. The first chamber 106 can be in fluid communication with the conduit 132, which can act as an inlet and an outlet for the first chamber 106. The first chamber 106 can include a sensor assembly 250.

The first motor assembly 108 can include a device 210 and a device 220. The devices 210, 220 can be vacuum motors mounted back-to-back to each other (e.g., via a mounting plate) such that the device 210 operates as a blower and the device 220 operates as a vacuum relative to the chamber 106. In some implementations, the devices 210, 220 are housed within the same cavity. The devices 210, 220 of the first motor assembly 108 can function as a motorized bellow that introduces air into and/or removes air from the chamber 106.

The device 210 can include a controller 214 and a motor 212. The controller 214 can receive electronic signals from the controller 180 (see FIG. 1C) and operate the motor 212. The device 210 can blow air into the first chamber 106 by actuating the motor 212. Operation of the device 210 can generate positive pressure in the first chamber 106 (e.g., to displace debris in the chamber 106 out of the chamber 106 via conduit 132).

The device 220 can include a controller 224 and a motor 222. The controller 224 can receive electronic signals from the controller 180 (see FIG. 1C) and operate the motor 222. The device 220 can remove air from the first chamber 106 by actuating the motor 222. Operation of the device 220 can generate negative pressure in the first chamber 106 (e.g., to suction debris into the chamber 106 via conduit 132). The controller 180 (see FIG. 1C) may not operate the device 210 and the device 220 of the first motor assembly 108 simultaneously.

The first motor assembly 108 can advantageously not include a diverter valve that diverts negative pressure (e.g., suction) and positive pressure (e.g., purge). By having the devices 210, 220 coupled back-to-back and sharing the same cavity, the devices 210, 220 can operate in an alternating fashion that does not require a diverter valve to effectuate suction into or purge out of the first chamber 106. The devices 210, 220 may both be coupled to a mounting plate 260. The mounting plate 260 can include a cut-out that allows the devices 210, 220 to be in fluid communication (e.g., without any valves or other obstructions in the fluid path between the devices 210, 220).

Figure 2B:
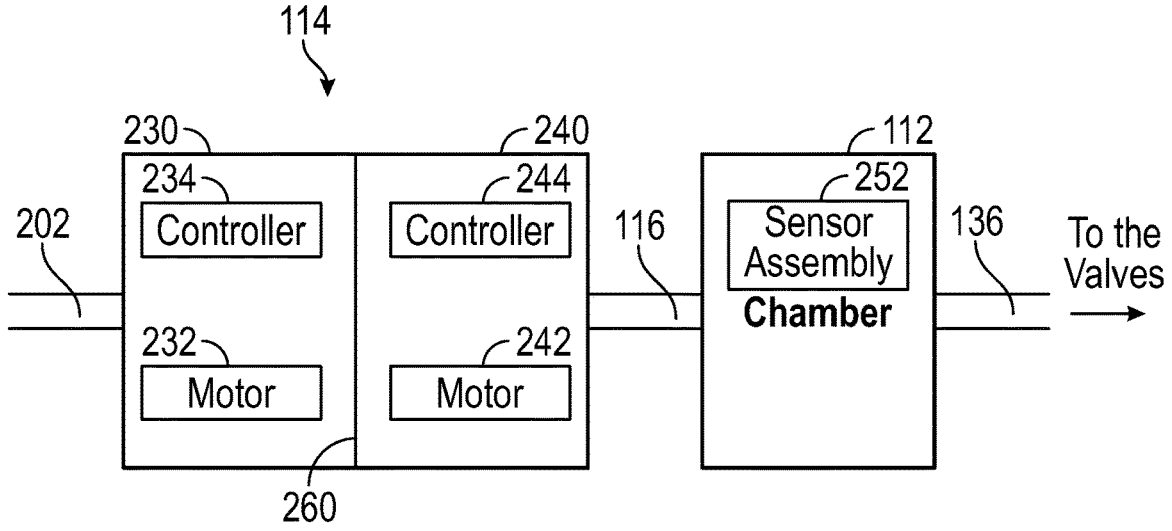
FIG. 2B is a block diagram of another example motor assembly.

FIG. 2B illustrates additional details of the second chamber 112 and the second motor assembly 114. The second chamber 112 and the second motor assembly 114 can be in fluid communication via a conduit 116. The conduit 116 can be attached to a top portion 164 of the second chamber 112. The second chamber 112 can be in fluid communication with the conduit 136, which can act as an inlet and an outlet for the second chamber 112. The second chamber 112 can include a sensor assembly 252.

The second motor assembly 114 can include a device 230 and a device 240. The devices 210, 220 can be vacuum motors mounted back to back to each other (e.g., via a mounting plate) such that the device 230 operates as a blower and the device 240 operates as a vacuum relative to the chamber 112. In some implementations, the devices 230, 240 are housed within the same cavity. The first device 230 and the second device 240 of the first motor assembly 108 can function as a motorized bellow that introduces air into and/or removes air from the chamber 112.

The device 230 can include a controller 234 and a motor 232. The controller 234 can receive electronic signals from the controller 180 (see FIG. 1C) and operate the motor 232. The device 230 can blow air into the second chamber 112 by actuating the motor 232. Operation of the device 240 can generate positive pressure in the second chamber 112 (e.g., to displace debris in the chamber 112 out of the chamber 112, such as via conduit 136).

The device 240 can include a controller 244 and a motor 242. The controller 244 can receive electronic signals from the controller 180 (see FIG. 1C) and operate the motor 242. The second device 240 can remove air from the second chamber 112 (e.g., to suction debris into the chamber 112 via conduit 136) by actuating the motor 242. Operation of the device 240 can generate negative pressure in the second chamber 112. The controller 180 may not operate the device 230 and the device 240 of the second motor assembly 114 simultaneously. [0066] The second motor assembly 114 may not include a diverter valve that diverts the negative pressure and positive pressure. As noted above, by having the devices 230, 240 coupled back-to-back and sharing the same cavity, the devices 230, 240 can operate in an alternating fashion that does not require a diverter valve to effectuate suction into or purge out of the second chamber 112. The devices 230, 240 may both be coupled to the mounting plate 260. The mounting plate 260 can include a cut-out that allows the devices 230, 240 to be fluidly coupled (e.g., without any valves or other obstructions in the fluid path between the devices 230, 240).

Figure 2C:
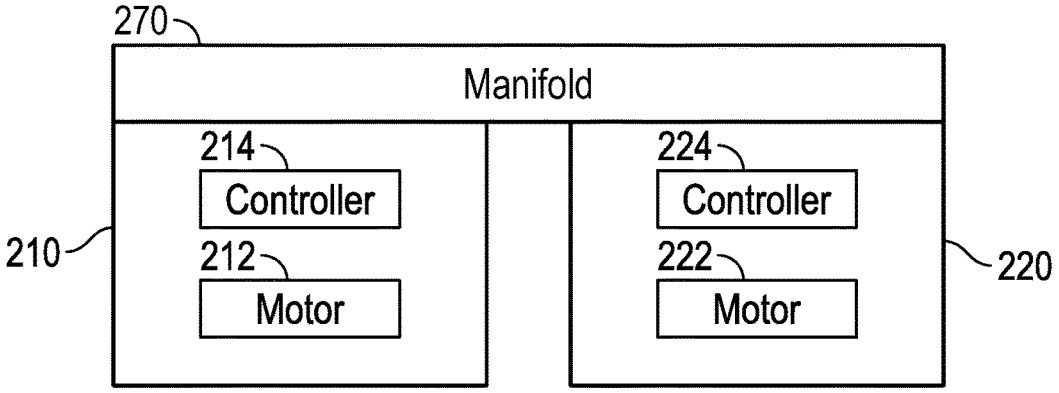
FIG. 2C is a block diagram of an example motor assembly with a different configuration.
Figure 2D:
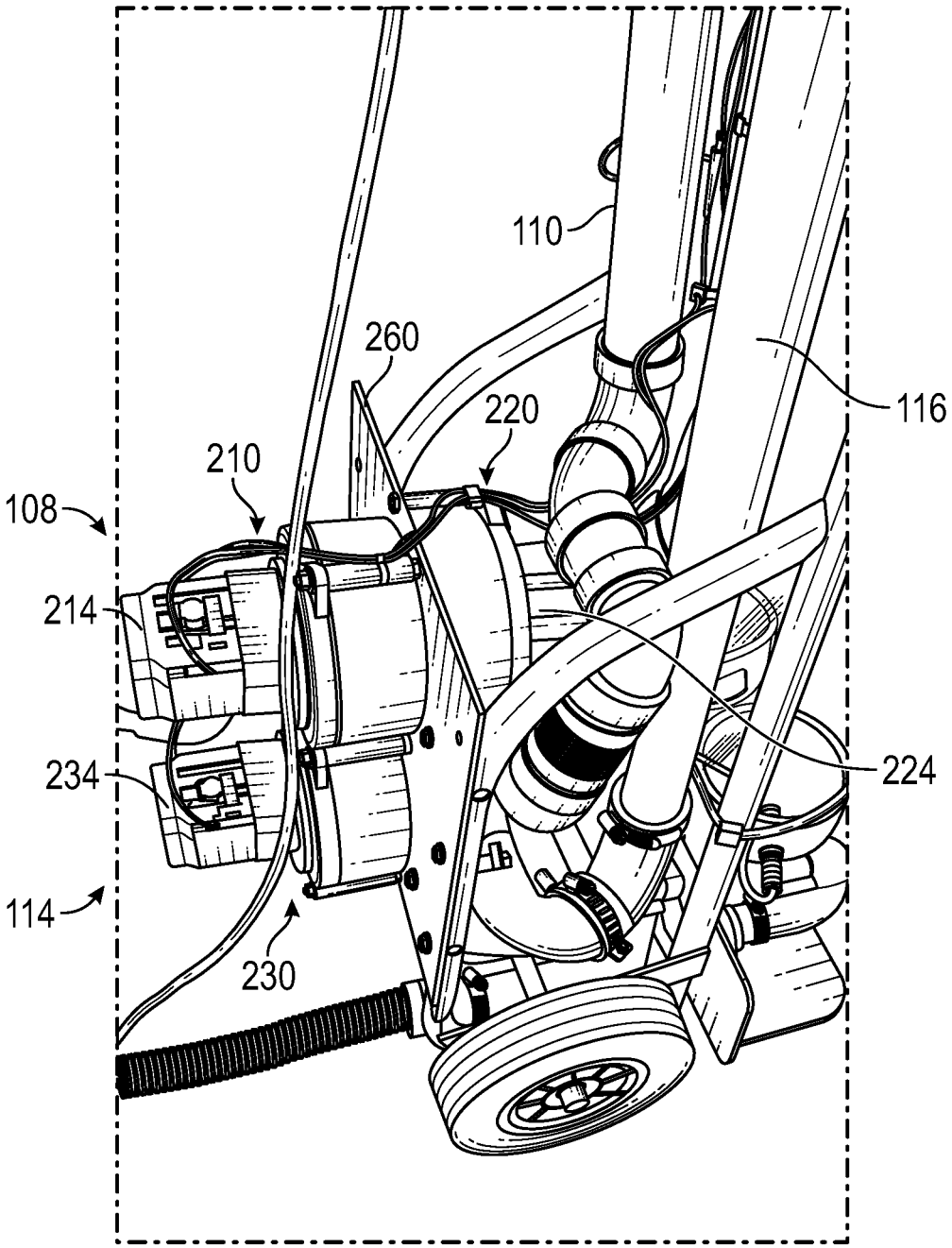
FIG. 2D is a partial left side and rear view of the pumping system in FIG. 1D showing example chamber assemblies and example motor assemblies.

Optionally, the devices 210, 220 and the devices 230, 240 can share the same mounting plate 260 (see FIG. 2D). Alternatively, the devise 210, 220 and the devices 230, 240 may not share the same mounting plate and have separate mounting plates.

The negative pressure in the chambers (for example, the first chamber 106 and the second chamber 112) can generate sufficient amount of suction force to siphon the debris into the pumping system 100. Additionally and/or alternatively, the suction force generated by the negative pressure can cause the debris to enter the filter system 120 and separate the fluid and/or smaller sized debris objects from the larger solid debris objects (e.g., rocks, sticks). Additionally and/or alternatively, the negative pressure can cause the fluid and/or smaller sized debris objects to leave the filter system 120 and enter the chambers (for example, the first chamber 106 and the second chamber 112).

Optionally, negative pressure in the first chamber 106 can cause the debris to enter the pumping system 100 via the inlet conduit 102 and the filter system 120 and route the fluid and/or smaller sized debris objects filtered by the filter system 120 to the first chamber 106 via the conduit 138, the valve 122, and the conduit 132. Optionally, negative pressure in the second chamber 112 can cause the debris to enter the pumping system 100 via the inlet conduit 102 and the filter system 120 and route the fluid and/or smaller sized debris objects filtered by the filter system 120 to the second chamber 112 via the conduit 138, the valve 126, and the conduit 136.

The positive pressure in the chambers (for example, the first chamber 106 and the second chamber 112) can eject the fluid and/or smaller sized debris objects stored in the chambers from the chambers. Additionally and/or alternatively, the positive pressure in the chambers can cause the fluid and/or smaller sized debris objects stored in the chamber to eject from the pumping system 100 via the outlet conduit 104.

Optionally, positive pressure in the first chamber 106 can remove the fluid and/or smaller sized debris objects stored in the first chamber 106. The fluid and/or smaller sized debris objects can flow out from the first chamber 106 via the conduit 132 and through the valve 124. The positive pressure can additionally eject the fluid and/or smaller sized debris objects from the pumping system 100 via the outlet conduit 104. Optionally, positive pressure in the second chamber 112 can remove the fluid and/or smaller sized debris objects stored in the second chamber 112. The fluid and/or smaller sized debris objects can flow out from the second chamber 112 via the conduit 136 and through the valve 128. The positive pressure can additionally eject the fluid and/or smaller sized debris objects from the pumping system 100 via the outlet conduit 104.

Optionally, the device 210 and the device 220 of the first motor assembly 108 (or the device 230 and the device 240 of the second motor assembly 114) may share a single controller that receives electronic signals from the controller 180. The single controller may communicate with the motor 212 and the motor 222 (or the motor 232 and the motor 242) to generate negative or positive pressure in the first chamber 106 (or the second chamber 112).

Optionally, the device 210 and the device 220 of the first motor assembly 108 (or the device 230 and the device 240 of the second motor assembly 114) may directly receive electronic signals from the controller 180 (e.g., the controllers 214, 224, 234, 244 can be excluded). In this regard, the controller 180 can directly communicate with the motors of the motor assemblies to generate negative and positive pressure in the chambers.

Optionally, the device 210 and the device 220 of the motor assembly 108, and device 230 and the device 240 of the motor assembly 114 may not be coupled back-to-back as described above. As shown in FIG. 2C, the device 210 and the device 220 of the motor assembly 108 may be coupled to a manifold 270 in parallel. The manifold 270 can define a space (e.g., flow path, conduit) that is coupled to both the device 210 and the device 220 such that the devices 210, 220 are fluidly coupled to the first chamber 106. The manifold 270 can be directly coupled to the first chamber 106 via the conduit 110. Optionally, the devices 230, 240 of the motor assembly 114 may be coupled in the same manner shown in FIG. 2C.

Figure 2E:
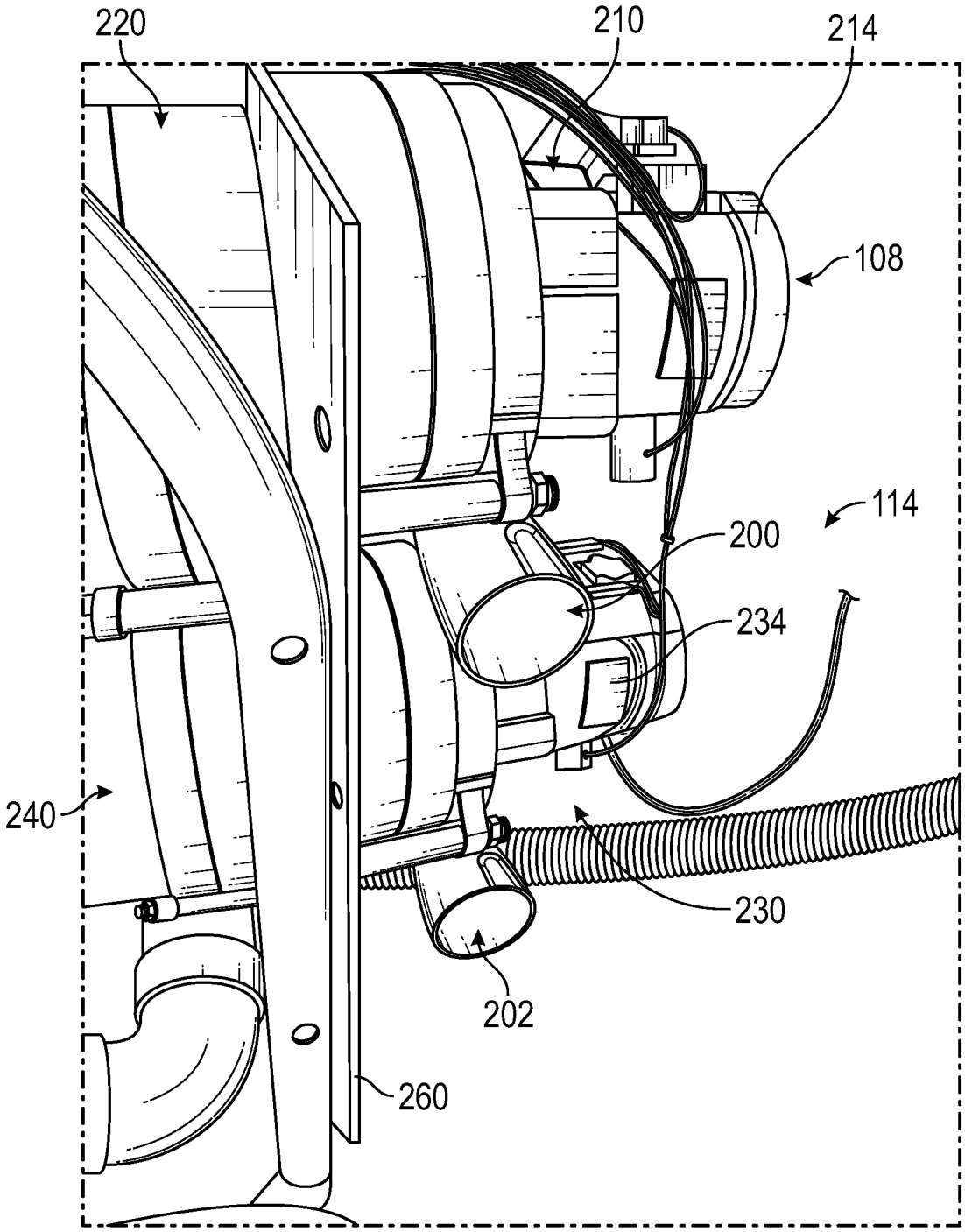
FIG. 2E is a partial right side view of the pumping system of FIG. 1D, showing example motor assemblies.

FIGS. 2D and 2E illustrate the motor assemblies 108, 114 of an example pumping system 100. As discussed above, the pumping system 100 can include the first motor assembly 108 that includes the device 210 and the device 220 (e.g., two vacuum motors 210, 220), and the second assembly 114 that includes the device 230 and the device 240 (e.g., two vacuum motors 230, 240).

The device 210 and the device 220 of the first motor assembly 108 can be coupled via a mounting plate 260. Additionally and/or alternatively, the device 210 and the device 220 can share a cavity or flow path such that air can flow within the first motor assembly 108 between the conduit 110 and an intake/exhaust opening 200 (see FIG. 2D) (e.g., depending on whether the motor assembly 108 is being operated to generate positive pressure in the chamber 106 or to generate negative pressure in the chamber 106). Likewise, the device 230 and the device 240 of the second motor assembly 114 can be coupled. Additionally and/or alternatively, the device 230 and the device 240 can share a cavity or flow path such that air can flow within the second motor assembly 114 between the conduit 116 and an intake/exhaust opening 202 (see FIG. 2D) (e.g., depending on whether the motor assembly 114 is being operated to generate positive pressure in the chamber 112 or to generate negative pressure in the chamber 112).

The openings (for example, the opening 200 and the opening 202) can act as an air inlet and outlet for the motor assemblies (for example, the first motor assembly 108 and the second motor assembly 114). When the device 210 operates and blows air into (e.g., generates positive pressure in) the first chamber 106, the air can enter the opening 200 and flows through the device 210 and the device 220. Alternatively, when the device 220 operates and removes air from (e.g., generates negative pressure in) the first chamber 106, the air can exit through the device 210, the device 220, and the opening 200. Similarly, the opening 202 can act as an air inlet and outlet for the second motor assembly 114.

Sensor System

Referring to FIGS. 1C, 2A, and 2B, sensor systems of the pumping system 100 are described. The chambers 106, 112 of the pumping system 100 can each include one or more sensors. The first chamber 106 can include the sensor assembly 250, which can have one or more sensors, and the second chamber 112 can include the sensor assembly 252, which can have one or more sensors. The sensor assembly 250 and the sensor assembly 252 can sense one or more parameters of the chambers 106, 112, generate one or more electronic signals corresponding to said sensed parameters, and send the electronic signals to the controller 180 (see FIG. 1C). In one implementation, the controller 180 can determine the amount (e.g., level) of debris (e.g., fluid and/or smaller sized debris objects) present in the first chamber 106 and the second chamber 112, respectively. The controller 180 can control the operation of the motor assemblies 108, 114 based at least in part on the one or more electronic signals it receives from the sensor assemblies 250, 252.

The sensor assemblies 250, 252 can each include one or more sensors that can detect the presence of liquid. The sensors can be any suitable liquid level sensors. Optionally, the sensor assembly (for example, the sensor assembly 250 or 252) can include capacitance level sensors that generate electronic signals upon detecting a change in capacitance caused by liquid contacting a probe (e.g., a probe that extends into the space within the chamber 106, 112). In one implementation, the sensors can generate electronic signals when no water is detected. The controller 180 can receive the electronic signals from the sensors to determine the amount of liquid present in the chambers (for example, the first chamber 106 and the second chamber 112); for example, the controller 180 can receive the electronic signals from the sensors to determine if the chamber (e.g., chamber 106 or 112) has reached a "full" level and needs to be emptied, or if the chamber (e.g., the chamber 112 or 106) has reached an "empty" level and needs to be filled with debris (e.g., fluid and/or smaller sized debris objects, such as mud, silt, pebbles).

The sensor assembly 250 of the first chamber 106 can include a sensor 422 and a sensor 420 (see FIG. 4B), where the sensor 422 is attached at or proximate a bottom portion 162 of the first chamber 106 and the sensor 420 is attached at or proximate the top portion 160 of the first chamber 106. In this regard, the controller 180 can determine the amount of (e.g., level of) fluid (e.g., liquid and/or smaller sized debris objects) in the first chamber 106 by monitoring signals received from the sensor 420 and the sensor 422. For example, the controller 180 may determine that the first chamber 106 is full or substantially full when it receives electronic signals indicative of presence of fluid (e.g., liquid and/or smaller sized debris objects) from both the sensor 420 and the sensor 422. Additionally and/or alternatively, the controller 180 may determine that the first chamber 106 is full or substantially full when it does not receive electronic signals indicative of absence of fluid (e.g., liquid and/or smaller sized debris objects) from both the sensor 420 and the sensor 422.

Optionally, the controller 180 may determine that the first chamber 106 is empty or substantially empty when it receives electronic signals indicative of absence of fluid (e.g., liquid and/or smaller sized debris objects) from the sensor 422 and the sensor 420. Additionally and/or alternatively, the controller 180 may determine that the first chamber 106 is empty or substantially empty when it does not receive electronic signals indicative of presence of fluid (e.g., liquid and/or smaller sized debris objects) from the sensor 422 and the sensor 420.

Optionally, the controller 180 may determine that the first chamber 106 is neither full nor empty when it receives an electronic signal indicative of presence of water from the sensor 422 and does not receive an electronic signal indicative of presence of water from the sensor 420. Additionally and/or alternatively, the controller 180 may determine that the first chamber 106 is neither full nor empty when it receives an electronic signal indicative of absence of water from the sensor 420 and does not receive an electronic signal indicative of absence of water from the sensor 422.

Likewise, the sensor assembly 252 of the second chamber 112 can include a sensor 424 and a sensor 426 (see FIG. 4B) that can communicate with the controller 180. The sensor 424 can be attached to or proximate the top portion 164 of the second chamber 112. The sensor 426 can be attached to or proximate a bottom portion 166 of the second chamber 112. As discussed above, the controller 180 can monitor electronic signals from the sensor 424 and the sensor 426 to determine the amount of fluid (e.g., liquid and/or smaller sized debris objects) stored in the second chamber 112.

Filter System

Figure 3:
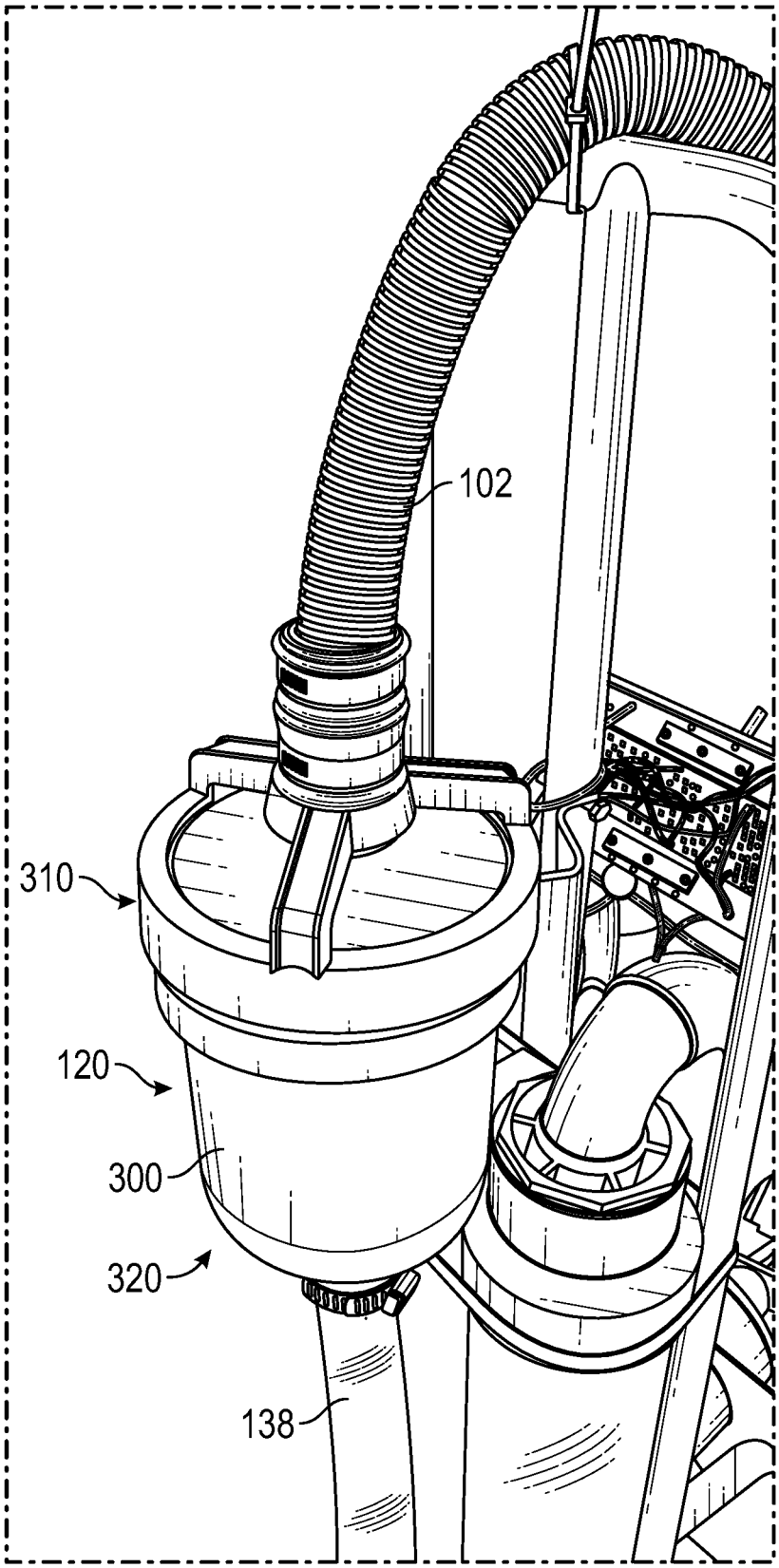
FIG. 3 is a partial perspective front view of the pumping system of FIG. 1D, showing a filter assembly.

FIG. 3 illustrates an example filter system 120 of the pumping system 100. The filter system 120 can include a cavity 300 and a filter that can separate liquid and/or small sized debris objects (e.g., mud, silt, pebbles) from larger sized debris objects (e.g., rocks, sticks). The filter can be placed within the cavity 300. The filter system 120 can be oriented such that gravitational forces can be utilized in its filtering process. For example, an inlet 310 of the filter system 120 can be located above an outlet 320 of the filter system 120 to further facilitate the filtering process. The filter system 120 can include one or more filters having different or same mesh size. Having filters with different mesh sizes can advantageously allow the pumping system 100 to effectively separate liquid and different types of debris (for example, gravel, silt, and the like) from larger types of debris (e.g., rocks, sticks). In another implementation, the filter system 120 can separate liquid from all other debris (e.g., gravel, silt, rocks, sticks, and the like).

The pumping system 100 can include one or more filter systems in various locations. Optionally, the pumping system 100 can include filter systems integrated to its chambers. Additionally or alternatively, the pumping system 100 can include filter systems integrated to or coupled to each valves (for example, the valve 122, the valve 124, the valve 126, and the valve 128).

Example Method of Debris Removal

Figure 4A:
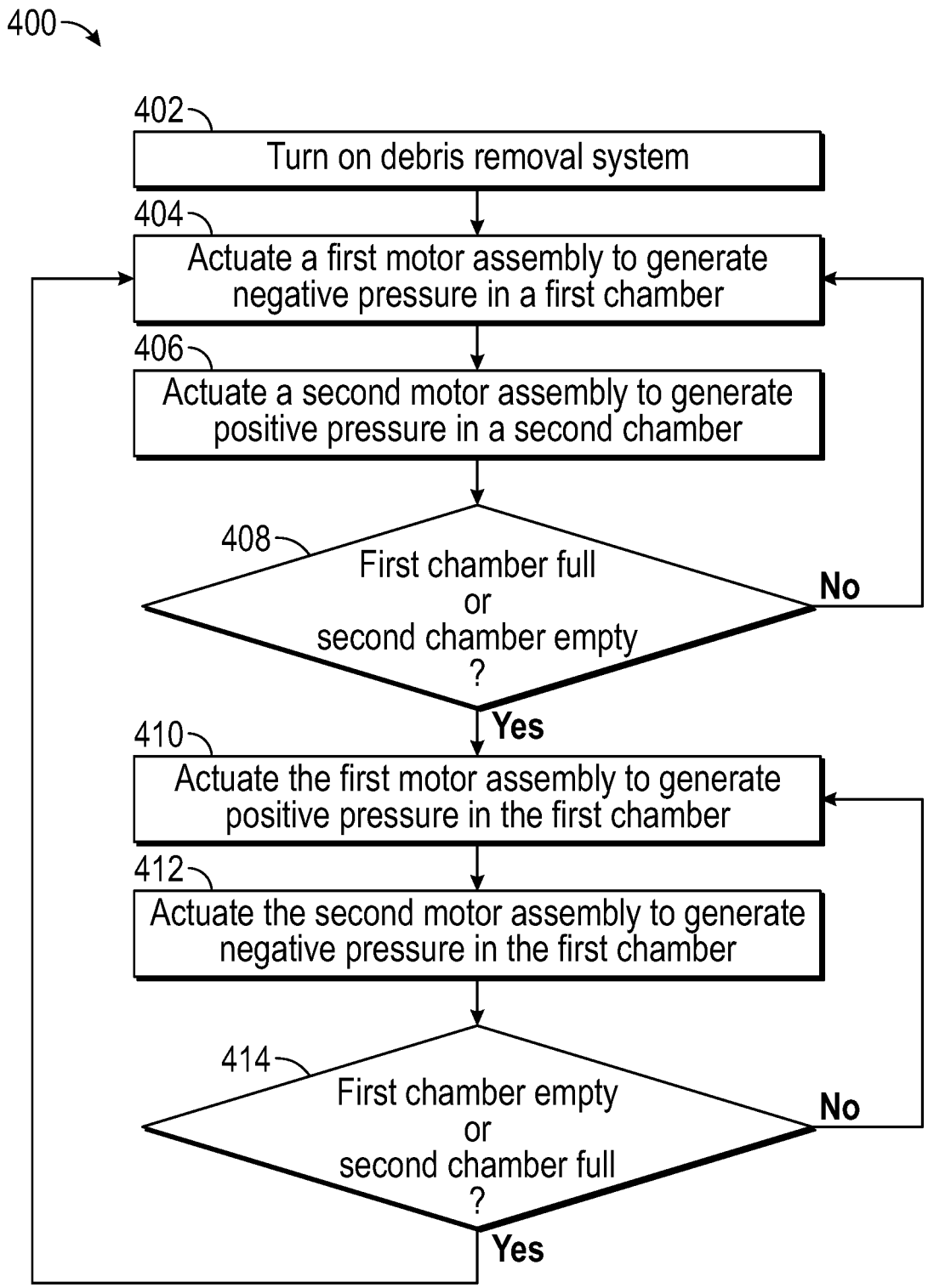
FIG. 4A is an example method of removing debris using the example pumping system of FIGS. 1A-1D.

FIG. 4A illustrates a method 400 of removing debris using the pumping system 100. At step 402, the pumping system 100 is actuated. Users can actuate the pumping system 100 via the user interface 182. The user can interact with the user interface 182 to control operation of the pumping system 100. For example, actuating the pumping system 100 can cause one of the first motor assembly 108 and the second motor assembly 114 to generate negative pressure in one of the first chamber 106 and the second chamber 112, and can cause the other of the first motor assembly 108 and the second motor assembly 114 to generate positive pressure in the other of the first chamber 106 and the second chamber 112.

Additionally or alternatively, the user can, via the user interface 182, actuate the first motor assembly 108 and the second motor assembly 114 to simultaneously generate negative pressure in the first chamber and the second chamber.

At step 404, the first motor assembly 108 generates negative pressure in the first chamber 106. The negative pressure in the first chamber 106 can be generated by the device 210 or the device 220 (e.g., vacuum motors) of the first motor assembly 108. The controller 180 can generate electronic signals to the controller 214 (or the controller 224) of the device 210 (or the device 220) to cause the motor 212 (or the motor 222) to generate negative pressure in the first chamber 106. As discussed above, the device 210 can generate negative pressure in the first chamber 106 by removing air from the first chamber 106. Alternatively, the device 220 can generate negative pressure in the first chamber 106 by removing air from the first chamber 106. The negative pressure created in the first chamber 106 can siphon debris into the pumping system 100 via the inlet conduit 102. Additionally, the negative pressure in the first chamber 106 can cause the fluid and/or smaller sized debris objects filtered by the filter system 120 to enter into the first chamber 106 via the conduit 138, the valve 122, and the conduit 132.

At step 406, the second motor assembly 114 generates positive pressure in the second chamber 112. The positive pressure in the second chamber 114 can be generated by the device 230 or the device 240 (e.g., vacuum motors) of the second motor assembly 114. The controller 180 can generate electronic signals to the controller 234 (or the controller 244) of the device 230 (or the device 240) to cause the motor 232 (or the motor 242) to generate positive pressure in the second chamber 112. As discussed above, the device 230 can generate positive pressure in the second chamber 106 by blowing air into the second chamber 112. Alternatively, the device 230 can generate positive pressure in the second chamber 112 by blowing air into second chamber 112. The positive pressure created in the second chamber 112 can eject fluid and/or smaller sized debris objects stored in the second chamber 112 and the pumping system 100 via the conduit 136, the valve 128, and the outlet conduit 104. Optionally, steps 404 and 406 occur simultaneously.

At step 408, the controller 180 can determine whether the first chamber 106 is full and/or the second chamber 112 is empty. The controller 180 can receive electronic signals from the sensors (for example, the sensor 420, the sensor 422, the sensor 424, and the sensor 426) coupled to the first chamber 106 and the second chamber 112 to determine whether the chambers are full, empty, or neither full nor empty.

If the controller 180 determines that either the first chamber 106 is full and/or the second chamber 112 is empty, the controller 180 can send electronic signals to the first motor assembly 108 to generate positive pressure in the first chamber 106 at step 410. If the controller 180 determines that first chamber is not full and the second chamber is not empty, the controller 180 can send electronic signals to the first motor assembly 108 to generate negative pressure in the first chamber 106 at step 404.

At step 412, the controller 180 can send electronic signals to the second motor assembly 114 to generate negative pressure in the second chamber 112.

At step 414, the controller can determine whether the first chamber 106 is empty and/or the second chamber 112 is full using electronic signals received from the sensors (for example, the sensor 420, the sensor 422, the sensor 424, and the sensor 426) coupled to the first chamber 106 and the second chamber 112.

If, at step 414, the controller 180 determine that either the first chamber 106 is empty or the second chamber 112 is full, the controller 180 can send electronic signals to the first motor assembly 108 to generate negative pressure in the first chamber 106 at step 404. If, at step 414, the controller 180 determined that the first chamber is not empty and the second chamber is not full, the controller 180 can send electronic signals to the first motor assembly 108 to generate positive pressure in the first chamber 106 at step 410.

Example Operation of Pumping system

Figure 4B:
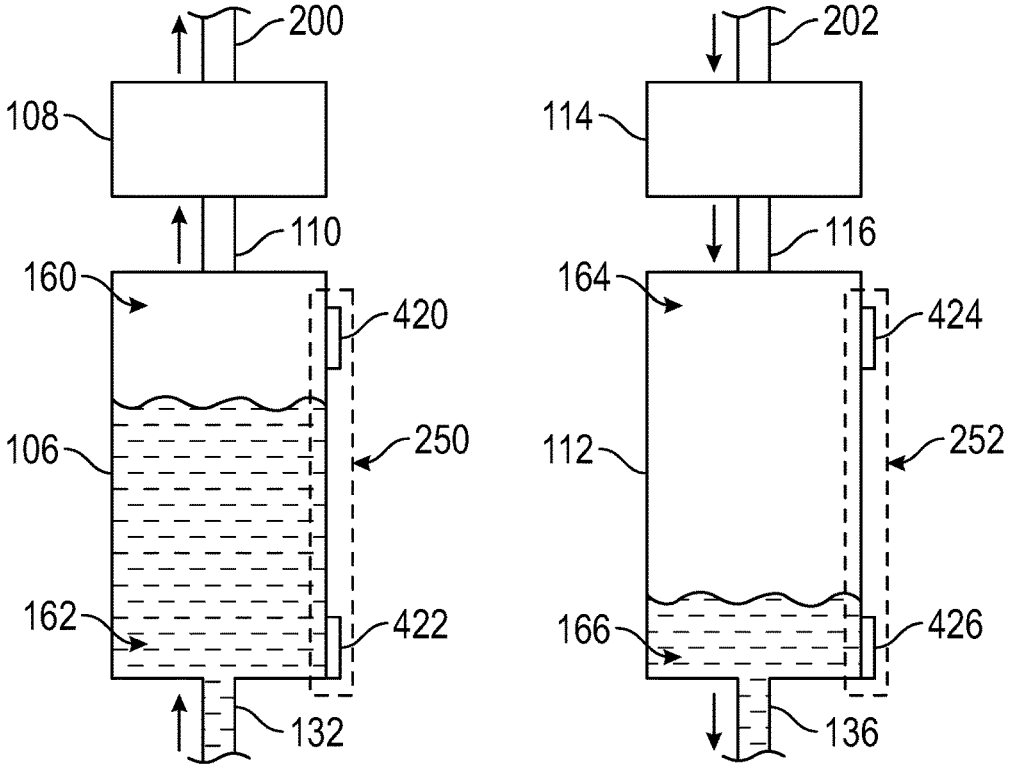
FIGS. 4B and 4C are illustrations of the method of removing debris using the example pumping system of FIGS. 1A-1D.
Figure 4C:
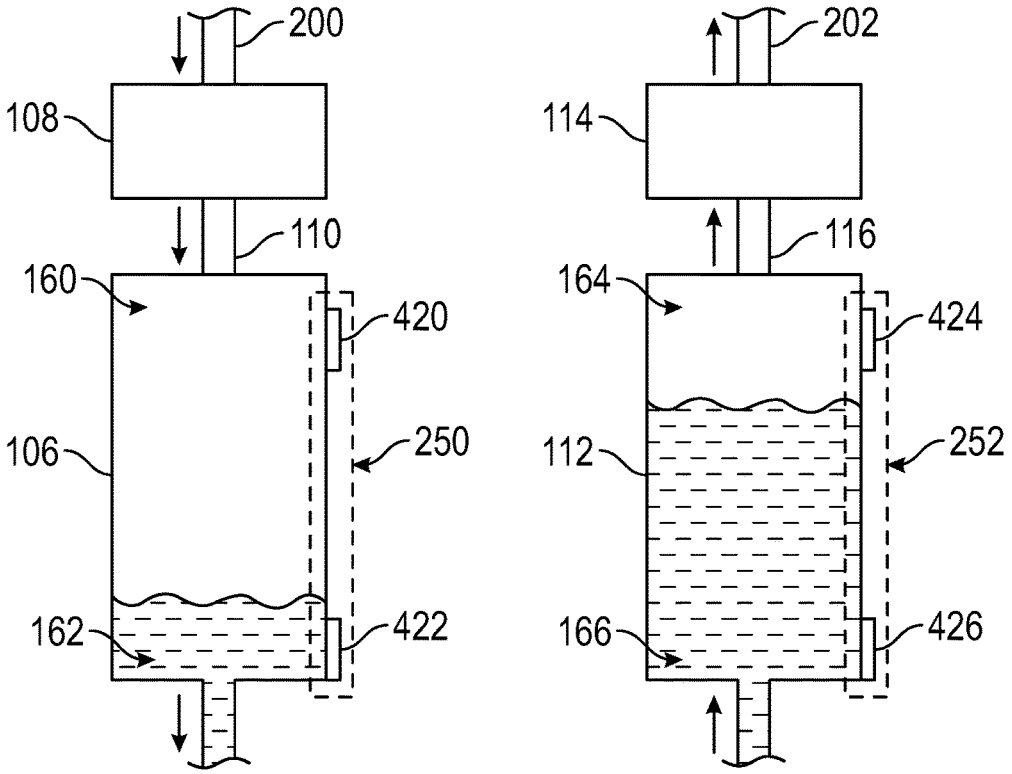

FIGS. 4B and 4C are illustrations of a method a removing debris using the pumping system 100. The first chamber 106, the second chamber 112, the first motor assembly 108, and the second motor assembly 114 can work together to remove debris. For example, as shown in FIG. 4B, the first motor assembly 108 can create negative pressure in the first chamber 106. The negative pressure can generate sufficient suction force to siphon debris through the inlet conduit 102 and separate fluid and/or smaller sized debris from the larger sized debris through the filter system 120. The fluid and/or smaller sized debris can further be pulled into the first chamber 106 via the conduit 132 in a direction indicated in FIG. 4B.

The negative pressure in the first chamber 106 can be sustained until the first chamber 106 is full or substantially full (e.g., the sensor 420 senses a level in the chamber 106 associated with a "full" level, though the sensor 420 does not need to be at the top of the chamber 106). Optionally, the negative pressure can be sustained (i.e., pull the liquid into the first chamber) until the sensor 420 detects presence of liquid. When the sensor 420 detects presence of liquid, the sensor 420 can generate and transmit an electronic signal to the controller 180 indicating the chamber 106 is "full". Upon receipt of the electronic signal from the sensor 420, the controller 180 can determine that the first chamber 106 is substantially full or full. Alternatively and/or additionally, the negative pressure in the first chamber 106 may be sustained until the second chamber 112 is empty or substantially empty (e.g., the sensor 426 senses a level in the chamber 112 associated with an "empty" level, though the sensor 426 does not need to be at the bottom of the chamber 112). Optionally, the negative pressure in the first chamber 106 can be sustained until the sensor 426 no longer detects presence of liquid. When the sensor 426 no longer detects presence of liquid, the sensor 426 can generate and transmit an electronic signal indicative of absence of liquid to the controller 180 indicating the chamber 112 is "empty". The controller 180, upon receipt of the electronic signal from the sensor 426, may determine that the second chamber 112 is substantially empty or empty.

Optionally, positive pressure may be generated in the second chamber 112 using the second motor assembly 114 simultaneously with negative pressure being generated in the first chamber 106 by the first motor assembly 108. As discussed earlier, positive pressure in the second chamber 112 can remove the liquid stored in the second chamber 112 via the conduit 236 and the valve 128. The simultaneous generation of negative pressure in the first chamber 106 and positive pressure in the second chamber 112 can allow the pumping system 100 to simultaneously siphon debris into the first chamber 106 and eject separated fluid and/or smaller sized debris from the second chamber 112. This configuration can advantageously allow continuous suction of debris into the pumping system 100 and continuous removal of separated fluid and/or smaller sized debris from the pumping system 100. In another implementation, generating negative pressure in the first chamber 106 and generating positive pressure in the second chamber 112 may not occur simultaneously.

When the controller 180 determines that the first chamber 106 is full or substantially full, the controller 180 can generate positive pressure in the first chamber 106 using the first motor assembly 108, as shown in FIG. 4C. Additionally and/or alternatively, the controller 180 can generate positive pressure in the first chamber 106 when it receives an electronic signal from the sensor 420, where the electronic signal is indicative of presence of water. Optionally, the controller 180 can generate negative pressure in the second chamber 112, as shown in FIG. 4C. The positive pressure in the first chamber 106 and the negative pressure in the second chamber 112 can be generated simultaneously or substantially simultaneously. As noted earlier, this configuration can advantageously allow continuous suction of debris into the pumping system 100 and continuous removal of separated liquid from the pumping system 100.

The positive pressure in the first chamber 106 can be sustained until the first chamber 106 is empty or substantially empty. Optionally, the positive pressure in the first chamber 106 can be maintained until the sensor 422 no longer detects presence of liquid. When the sensor 422 no longer detect presence of liquid, the sensor 422 can generate and transmit an electronic signal to the controller 180, where the signal is indicative of absence of liquid. Upon receiving the electronic signal from the sensor 422, the controller 180 can determine that the second chamber 112 is empty or substantially empty.

Optionally and/or additionally, the positive pressure in the first chamber 106 can be sustained until the second chamber 112 is full or substantially full. Optionally, the positive pressure in the first chamber 106 can be sustained until the sensor 424 of the second chamber 112 detects presence of liquid. When the sensor 424 detects presence of liquid, it can generate and transmit an electronic signal indicative of presence of liquid to the controller 180. The controller can, upon receipt of the electronic signal from the sensor 424, determine that the second chamber 112 is full or substantially full.

The liquid level sensors (for example, the sensor 420 and the sensor 424) can optionally be placed some distance away from the conduit 110, 116 to inhibit (e.g., prevent) flow of fluid and/or smaller sized debris into the conduit 110, 116 to avoid contact with the motor assemblies 108, 114, thereby advantageously avoiding damage to the motor assemblies 108, 114.

Optionally, the chambers (for example, the first chamber 106 and the second chamber 112) can include three or more level sensors. For example, the first chamber 106 can include two level sensors coupled at its bottom portion and two level sensors coupled at its top portion. The redundancy of the level sensors can further ensure correct operation of the pumping system 100 and reduce the risk of damage to various components such as the first motor assembly 108 and the second motor assembly 114.

Other Example Operations of Pumping System

Optionally, the first motor assembly 108 and the second motor assembly 114 can simultaneously generate negative pressure in the first chamber 106 and the second chamber 112, respectively. Additionally, the first motor assembly 108 and the second motor assembly 114 can simultaneously generate positive pressure in the first chamber 106 and the second chamber 112, respectively. In this regard, the fluid and/or smaller sized debris separated by the filter system 120 can simultaneously be routed to the first chamber 106 and the second chamber 112. Additionally, the debris in the first chamber 106 and the second chamber 112 once full can simultaneously be removed via the outlet conduit 104. Although this configuration may not allow continuous removal of debris from flooded area, it can provide additional suction force by having both the first motor system 108 and the second motor system 114 generate negative pressure in the first chamber 106 and the second chamber 112, respectively.

The user interface 182 and the controller 180 can allow users to decide whether to use the first chamber 106 (and the first motor assembly 108) and the second chamber 112 (and the second motor assembly 114) simultaneously or alternatingly. As discussed above, the chambers and the corresponding motor assemblies can operate in an alternating fashion such that one chamber siphons filtered fluid and/or smaller sized debris while the other chamber simultaneously ejects the siphoned fluid and/or smaller sized debris. Alternatively, the chambers and corresponding motor assemblies can operate simultaneously such that the chambers siphon debris simultaneously and eject siphoned debris simultaneously.

The pumping system 100 can include two or more chambers and corresponding motor assemblies. For example, the pumping system 100 may include four chambers and four corresponding motor assemblies that can generate negative or positive pressure in corresponding chambers.

Optionally, the pumping systems 100 can be coupled in series (e.g., in a daisy chain) to remove debris over a longer distance, or in parallel to remove a larger amount of debris in a shorter amount of time. The pumping systems 100 can communicate with other pumping systems 100 via a wired and/or wireless communication protocol. The pumping systems 100 can communicate to coordinate operation of their respective motor assemblies and chambers to remove liquid medium from flooded area more efficiently.

Optionally, the pumping system 100 may be modular such that it can be mounted on another device for improved transportability.

While certain applications of the pumping system 100 have been described, the pumping system 100 may be used for pumping and/or transporting various types of materials having one or both of fluid (gas and/or liquid) and solid between different locations.

Optionally, the pumping system 100 may be used at a dairy farm or factor in transporting different type of dairy products (for example, milk, custard, curd, cheese, butter, and the like) from one location to another. For example, the pumping system 100 can be used to transport finished products to a packaging area.

Optionally, the pumping system 100 may be used to transport or pump different types of waste (for example, organic waste, inorganic waste, hazardous waste, recyclable waste, and the like) from one location to another. In some implementations, the pumping system 100 can be used to remove animal waste (e.g., from a facility with livestock). In some implementations, the pumping system 100 can be used to remove food waste.

Optionally, the pumping system 100 can also be used as a gas feeding system, ventilation system, or purging system that may require moving different types of gases to and from different locations. In some implementations, the pumping system 100 can be used to provide ventilation for factories, hospitals, or other industrial locations that require continuous ventilation.

Optionally, the pumping system 100 may be used to transport hazardous or non-hazardous chemicals to and from different locations.

Optionally, the pumping system 100 may be used in various fire suppression applications. As discussed above, the pumping system 100 can create continuous suction and removal of liquid and/or solid. In this regard, the pumping system 100 may be used to siphon water from a water source and purge the siphoned water for fire suppression. In some implementations, the pumping system 100 may be used as portable fire suppression device for private residences. Users may place the intake conduit 102 of the pumping system 100 in a pool, for example, and use the pumping system 100 to siphon water from the pool and pump water out for fire suppression. The pump system 100 may be especially useful in fighting fire in residential areas having houses with pools, or near lakes, lagoons, ponds or other bodies of water.

Optionally, the pumping system 100 can be used as a fire suppression unit mounted on a vehicle. The sizes of various components of the pumping system 100 may be varied to adjust the pumping system 100 for different applications requiring different volume of water pumped per second or water pressure. For example, the pumping system 100 can include larger gas or diesel-powered motors to achieve greater pump pressure (i.e., increased suction and pumping). In this regard, the pumping system 100 may be used in larger operations (for example, hazardous spill containment and larger-scale fire suppression).

Optionally, the pumping system 100 can be used in spill removal applications, such as spills on roads or highways, to remove spilled fluids (e.g., oil, gasoline, chemicals, etc).

The examples above describe herein some non-limiting applications or uses of the pumping system 100 and are not intended to limit the scope of possible uses of the pumping system 100.

Terminology

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A pumping system comprising:

an inlet conduit;

an outlet conduit;

a first chamber assembly comprising a first chamber, the first chamber in fluid communication with the inlet conduit and the outlet conduit;

a first motor assembly in fluid communication with the first chamber assembly and comprising a first pair of vacuum motors coupled back-to-back so that a first vacuum motor of the first pair of vacuum motors operates as a vacuum to apply a negative pressure force to the first chamber, and so that a second vacuum motor of the first pair of vacuum motors operates as a blower to apply a positive pressure force to the first chamber;

a second chamber assembly comprising a second chamber, the second chamber in fluid communication with the inlet conduit and the outlet conduit;

a second motor assembly in fluid communication with the second chamber assembly and comprising a second pair of vacuum motors coupled back-to-back so that a first vacuum motor of the second pair of vacuum motors operates as a vacuum to apply a negative pressure force to the second chamber, and so that a second vacuum motor of the second pair of vacuum motors operates as a blower to apply a positive pressure force to the second chamber; and a controller configured to alternatingly operate the first motor assembly and the second motor assembly such that the first motor assembly generates negative pressure in the first chamber while the second motor assembly generates positive pressure in the second chamber, or the first motor assembly generates positive pressure in the first chamber while the second motor assembly generates negative pressure in the second chamber.

2. The pumping system of claim 1, wherein the inlet conduit, the outlet conduit, the first chamber, and the first motor assembly are in fluid communication via a conduit system.

3. The pumping system of claim 1, wherein the first motor assembly comprises a mounting plate to which the first pair of vacuum motors are coupled.

4. The pumping system of claim 1, wherein the controller simultaneously operates the first motor assembly and the second motor assembly such that the first motor assembly and the second motor assembly simultaneously generate negative pressure or positive pressure in the first chamber and the second chamber, respectively.

5. The pumping system of claim 1, further comprising;

a first pair of sensors on or in the first chamber at two locations of the first chamber, the first pair of sensors configured to detect a fluid level in the first chamber and to generate a signal of such detection corresponding to a chamber empty or a chamber full condition, and to send the signal to the controller, the controller configured to operate the first motor assembly to suction material having one or both a fluid and a solid into the first chamber upon receipt of said chamber empty signal and configured to operate the first motor assembly to purge the siphoned material from the first chamber upon receipt of said chamber full signal; and a second pair of sensors on or in the second chamber at two locations of the second chamber, the second pair of sensors configured to detect presence of material in the second chamber, generate a signal corresponding to a chamber empty or a chamber full condition, and send the signal to the controller, the controller configured to operate the second motor assembly to suction material having one or both a fluid and a solid into the second chamber upon receipt of said chamber empty signal and configured to operate the second motor assembly to purge the siphoned material from the second chamber upon receipt of said chamber full signal.

6. The pumping system of claim 5, wherein the first and the second pair of sensors are capacitance sensors.

7. The pumping system of claim 1, wherein operation of the first motor assembly and the second motor assembly causes the pumping system to receive a continuous intake of siphoned material via the inlet conduit.

8. The pumping system of claim 1, wherein the first chamber assembly and the second chamber assembly are fluidly isolated such that the siphoned material cannot flow from the first chamber to the second chamber or from the second chamber to the first chamber.

9. The pumping system of claim 1 further comprising a filter system in fluid communication with the inlet conduit and comprising one or more filters.

10. The pumping system of claim 1, wherein the first motor assembly does not comprise a mechanical diverting valve to effect suction into and purge out of the first chamber.

11. A pumping system for pumping material having one or both a fluid and a solid, the system comprising:

an inlet conduit;

an outlet conduit;

a first chamber assembly comprising a first chamber, the first chamber assembly in fluid communication with the inlet conduit and the outlet conduit;

a first motor assembly in fluid communication with the first chamber and comprising a first pair of vacuum motors coupled back-to-back so that a first vacuum motor of the first pair of vacuum motors operates as a vacuum to apply a negative pressure force to the first chamber, and so that a second vacuum motor of the first pair of vacuum motors operates as a blower to apply a positive pressure force to the first chamber;

a second chamber assembly comprising a second chamber, the second chamber assembly in fluid communication with the inlet conduit and the outlet conduit;

a second motor assembly in fluid communication with the second chamber assembly and comprising a second pair of vacuum motors coupled back-to-back so that a first vacuum motor of the second pair of vacuum motors operates as a vacuum to apply a negative pressure force to the second chamber, and so that a second vacuum motor of the second pair of vacuum motors operates as a blower to apply a positive pressure force to the second chamber; and a controller configured to:

operate the first motor assembly to alternatingly apply a negative pressure force on the first chamber to siphon material having one or both a fluid and a solid through the inlet conduit and into the first chamber, and apply a positive pressure force to the first chamber to purge the siphoned material from the first chamber without the first motor assembly coming into contact with the siphoned fluid and debris, and operate the second motor assembly to alternatingly apply a negative pressure force on the second chamber to siphon material having one or both a fluid and a solid through the inlet conduit and into the second chamber, and apply a positive pressure force to the second chamber to purge the siphoned material from the second chamber without the second motor assembly coming into contact with the siphoned fluid and debris.

12. The pumping system of claim 11, wherein the controller simultaneously operates the first motor assembly and the second motor assembly such that the first motor assembly and the second motor assembly simultaneously generate negative pressure or positive pressure in the first chamber and the second chamber, respectively.

13. The pumping system of claim 11, wherein the first motor assembly and the second motor assembly simultaneously and alternatingly operate such that the first motor assembly generates negative pressure in the first chamber while the second motor assembly generates positive pressure in the second chamber, or the first motor assembly generates positive pressure in the first chamber while the second motor assembly generates negative pressure in the second chamber.

14. The pumping system of claim 11, further comprising:

a first pair of sensors on or in the first chamber at two locations of the first chamber, the pair of sensors configured to detect presence of material in the first chamber, generate a signal corresponding to a chamber empty or a chamber full condition, and send the signal to the controller, the controller configured to operate the first motor assembly to suction material having one or both a fluid and a solid into the first chamber upon receipt of said chamber empty signal and configured to operate the first motor assembly to purge siphoned material from the first chamber upon receipt of said chamber full signal; and a second pair of sensors on or in the second chamber at two locations of the second chamber, the pair of sensors configured to detect presence of material in the second chamber, generate a signal corresponding to a chamber empty or a chamber full condition, and send the signal to the controller, the controller configured to operate the second motor assembly to suction material having one or both a fluid and a solid into the second chamber upon receipt of said chamber empty signal and configured to operate the second motor assembly to purge the siphoned material from the second chamber upon receipt of said chamber full signal.

15. The pumping system of claim 11, wherein the inlet conduit, the first chamber assembly, the second chamber assembly, the first motor assembly, and the second motor assembly are in fluid communication via a conduit system.

16. A pumping system comprising:

an inlet conduit;

an outlet conduit;

a first chamber assembly comprising a first chamber, the first chamber in fluid communication with the inlet conduit and the outlet conduit;

a first motor assembly in fluid communication with the first chamber assembly and comprising a first pair of vacuum motors in fluid communication with each other via a first manifold, the manifold in fluid communication with the first chamber, so that a first vacuum motor of the first pair of vacuum motors operates as a vacuum to apply a negative pressure force to the first chamber, and so that a second vacuum motor of the first pair of vacuum motors operates as a blower to apply a positive pressure force to the first chamber;

a second chamber assembly comprising a second chamber, the second chamber in fluid communication with the inlet conduit and the outlet conduit;

a second motor assembly in fluid communication with the second chamber assembly and comprising a second pair of vacuum motors in fluid communication with each other via a second manifold, the manifold in fluid communication with the second chamber, so that a first vacuum motor of the second pair of vacuum motors operates as a vacuum to apply a negative pressure force to the second chamber, and so that a second vacuum motor of the first pair of vacuum motors operates as a blower to apply a positive pressure force to the second chamber; and a controller configured to operate the first motor assembly and the second motor assembly to alternatingly apply a negative pressure force on the first chamber and the second chamber to siphon material having one or both of a fluid and a solid through the inlet conduit and into the first chamber and the second chamber, and to alternatingly apply a positive pressure force to the first chamber and the second chamber to purge the siphoned material from the first chamber and the second chamber without either motor assembly coming into contact with the siphoned material.

17. The pumping system of claim 16, wherein the controller simultaneously operates the first motor assembly and the second motor assembly such that the first motor assembly and the second motor assembly simultaneously generate negative pressure or positive pressure in the first chamber and the second chamber, respectively.

18. The pumping system of claim 16, wherein the inlet conduit, the first chamber assembly, the second chamber assembly, the first motor assembly, and the second motor assembly are in fluid communication via a conduit system.

19. The pumping system of claim 16, further comprising:

a first pair of sensors on or in the first chamber at two locations of the first chamber, the pair of sensors configured to detect presence of material in the first chamber, generate a signal corresponding to a chamber empty or a chamber full condition, and send the signal to the controller, the controller configured to operate the first motor assembly to suction material having one or both a fluid and a solid into the first chamber upon receipt of said chamber empty signal and configured to operate the first motor assembly to purge siphoned material from the first chamber upon receipt of said chamber full signal; and a second pair of sensors on or in the second chamber at two locations of the second chamber, the pair of sensors configured to detect presence of material in the second chamber, generate a signal corresponding to a chamber empty or a chamber full condition, and send the signal to the controller, the controller configured to operate the second motor assembly to suction material having one or both a fluid and a solid into the second chamber upon receipt of said chamber empty signal and configured to operate the second motor assembly to purge the siphoned material from the second chamber upon receipt of said chamber full signal.

20. The pumping system of claim 16, wherein the operation of the first motor assembly and the second motor assembly causes the pumping system to receive a continuous intake of siphoned material via the inlet conduit.

* * * * *